United States Patent [19]

Teruyama et al.

[11] Patent Number: 4,859,161

[45] Date of Patent: Aug. 22, 1989

[54] GEAR PUMP

[75] Inventors: Hideo Teruyama, Saitama; Masaru Yano, Chiba, both of Japan

[73] Assignee: Kayaba Industry Co. Ltd., Japan

[21] Appl. No.: 187,088

[22] Filed: Apr. 28, 1988

[30] Foreign Application Priority Data

May 7, 1987 [JP] Japan ..... 62-110968

[51] Int. Cl.[4] ..... F04C 29/02

[52] U.S. Cl. ..... 418/102

[58] Field of Search ..... 418/39, 102, 131, 132

[56] References Cited

U.S. PATENT DOCUMENTS

| | | | |
|---|---|---|---|
| 2,479,077 | 8/1949 | McAlvay | 418/102 X |
| 3,490,382 | 1/1970 | Joyner | 418/102 |
| 3,528,756 | 9/1970 | Norlin et al. | 418/102 X |
| 4,090,820 | 5/1978 | Teruyama | 418/102 X |
| 4,265,602 | 5/1981 | Teruyama | 418/102 X |
| 4,392,798 | 7/1983 | Bowden | 418/102 |

FOREIGN PATENT DOCUMENTS

| | | | |
|---|---|---|---|
| 2502793 | 7/1976 | Fed. Rep. of Germany | 418/102 |
| 1333430 | 6/1963 | France | 418/102 |

*Primary Examiner*—Michael Koczo

*Attorney, Agent, or Firm*—Steinberg & Raskin

[57] ABSTRACT

A gear pump constructed in such a manner that bearing bushings are pressedly inserted in bushing insertion holes for supporting gear shafts therein, side plate are arranged on both sides of gears, and a part of hydraulic oil in a suction chamber is circulated through a lubricating oil introduction passage formed on an inside of each of the bearing bushings and a lubricating oil return passage formed on an outside of each of the bearing bushings. The lubricating oil return passages have outlets positioned in a manner to be laterally symmetric on the basis of a vertical line defined by connecting centers of the gear shafts and vertically symmetric on the basis of a horizontal line extending through a center of the vertical line and perpendicular to the vertical line. The side plates each are formed with a through-hole which is positioned on one side of the vertical line so as to be communicated to both outlets of the lubricating return passages vertically symmetric on the basis of the horizontal line. Also, the side plates are formed with cutouts for communicating the inlets of the lubricating oil introduction passages to the suction chamber. Thus, the gear pump accomplishes a variation of a direction of rotation of the pump by merely rotating the side plates by an angle of 180 degrees without replacing any parts.

3 Claims, 3 Drawing Sheets

GEAR PUMP

BACKGROUND OF THE INVENTION

1. Field of the Invention

This invention relates to a gear pump, and more particularly to a gear pump which is adapted to circulate low pressure oil on a suction side to lubricate and cool gear shafts of the gear pump.

2. Description of the Prior Art

A conventional gear pump is typically constructed in a manner as shown in FIGS. 1 to 3. More particularly, it includes a body section 1 and a pair of gears 2 and 3 arranged in the body section 1. The body section 1 is closed on both sides thereof with a cover 4 and a mounting flange 5. The mounting flange 5 and cover 4 are each formed with a pair of bushing insertion holes 6, 7 and 8, 9 into which each pair of bearing bushings 10, 11 and 12, 13 is securely inserted to support each pair of gear shafts 14, 15 and 16, 17 therein, respectively. On both sides of the gears 2 and 3 are arranged side plates 18 and 19 which serve to seal tooth spaces of the gears 2 and 3.

The bearing bushings 10 to 13 are arranged in the corresponding holes 6 to 9 in a manner to inwardly project at one end thereof from the cover 4 and mounting flange 5 and the projecting ends are fitted in recesses 18*a* and 19*a* respectively formed at the side plates 18 and 19 as shown in detail in FIG. 3. Between the inner ends of the bearing bushings 10 to 13 and bottoms of the recesses 18*a* and 19*a* are defined annular gaps 20 to 23, respectively, which are communicated through annular passages 18*b* and 19*b* formed at the side plates 18 and 19 to side surfaces of the gears 2 and 3 to form lubrication passageways.

The lubrication passageways are symmetrically formed. The following description will be made in connection with the passageways defined on a side of the mounting flange 5.

On an outer surface of the side plate 18 is superposedly arranged an isolation plate 24 as shown in FIG. 2. The isolation plate 24 is formed into a shape corresponding to a low pressure area L on the outer surface of the side plate 18. Reference numeral 25 designates a seal fittedly arranged so as to extend from a circumference of each of the bearing bushings 10 and 11 to a level difference portion between the isolation plate 24 and the side plate 18. The seal 25 serves to define a high pressure area H on the outer surface side of the side plate 18, in addition to the above-described low pressure area L. Low pressure formed on a side of a suction port 26 acts on the low pressure area L, whereas high pressure formed on a side of a discharge port 27 acts on the high pressure area H.

Also, the side plate 18 is formed on an inner surface thereof contacted with the gears 2 and 3 with a pair of introduction ports 18*c* and 18*d* for introducing low pressure oil therethrough, through which the suction port 26 and the above-described annular passage 18*b* are communicated to each other. Low pressure oil introduced through the ports 18*c* and 18*d* flows through the annular passage 18*b* to the annular gaps 20 and 21.

The bearing bushings 10 and 11 are formed with oil grooves 28 and 29 which extend in axial directions thereof, respectively. The oil grooves 28 and 29 serve to communicate end chambers 30 and 31 with the body section 1 in a manner to be contiguous or adjacent to outer ends of the gears 14 and 15 to the annular gaps 20 and 21 therethrough, respectively.

The end chambers 30 and 31 so communicated to the low pressure oil introducing ports 18*c* and 18*d* are communicated through return passages 32 and 33 and communication passages 34 and 35 to the suction port 26, respectively. The return passages 32 and 33 are formed using grooves formed on inner surfaces of the bushing insertion holes 6 and 7 so as to extend in axial directions thereof, respectively. More particularly, the bearing bushings 10 and 11 are pressedly inserted in the insertion holes 6 and 7 formed with the grooves to close one side of each of the grooves, resulting in the return passages 32 and 33. Accordingly, the return passages 32 and 33 may be formed using a die, for example by, aluminum die casting.

The communication passages 34 and 35 are formed by closing, with the isolation plate 24, recesses formed on an inner surface of the mounting flange 5 contacted with the isolation plate 24 during die casting.

Low pressure oil introduced through the suction port 26 into the low pressure introduction ports 18*c* and 18*d* is then circulated through the annular passage 18*b* , annular gaps 20 and 21, oil grooves 28 and 29, end chambers 30 and 31 of the gear shafts 14 and 15, return passages 32 and 33 and communication passages 34 and 35 while exhibiting its lubrication function and cooling the gear shafts.

As can be seen from the foregoing, in the conventional gear pump constructed as described above, a positional relationship between an inlet of the circulation passageway for lubricating oil and its outlet is limitedly specified. Accordingly, it has a disadvantage of failing to vary its rotational direction as desired.

SUMMARY OF THE INVENTION

The present invention has been made in view of the foregoing disadvantage of the prior art.

Accordingly, it is an object of the present invention to provide a gear pump which is capable of variably determining a positional relationship between an inlet of a circulation passageway for lubricating oil and its outlet, resulting in being accommodated to a variation in a direction of rotation of the pump.

It is another object of the present invention to provide a gear pump which is capable of optimumly operating under low discharge pressure.

It is a further object of the present invention to provide a gear pump which is capable of bearing high pressure.

It is still another object of the present invention to provide a gear pump which is capable of accomplishing the above-noted objects with a simple structure.

In accordance with the present invention, a gear pump is provided. The gear pump includes a pump body formed with bushing insertion holes and a gear hole in which gears are arranged. In the bushing insertion holes are pressedly inserted bearing bushings each of which is formed on an inside thereof with a lubricating oil introduction passage and on an outside thereof with a lubricating oil return passage. In each of the bearing bushings is rotatably supported a gear shaft. Also, the gear pump includes at least one side plate arranged on at least one side of each of the gears and a suction chamber defined in the pump body so as to circulate a part of hydraulic fluid on the suction chamber side through the lubricating oil introduction passages and the lubricating oil return passages The lubricating oil return passages have outlets positioned in a manner to be laterally symmetric on the basis of a vertical line defined by connecting centers of the gear shafts and vertically symmetric on the basis of a horizontal line extending through a center of the vertical line and perpendicular thereto and are also formed with inlets.

In a preferred embodiment of the present invention, the lubricating oil return passage is communicated at an end thereof opposite to its outlet to an end chamber defined in the pump body and the lubricating oil introduction passage is communicated at an inlet and an outlet thereof to a side surface of the gear and the end chamber, respectively.

The side plate is formed with a through-hole which is positioned on one side of the vertical line so as to be communicated to both outlets of the lubricating return passages vertically symmetric on the basis of the horizontal line and a cutout for communicating the inlet of the lubricating oil introduction passage to the suction chamber.

In the present invention constructed as described above, rotation of the side plate by an angle of 180 degrees causes positional relationships between the inlets of the lubricating oil introduction passages and the outlets of the lubricating oil return passages to be varied at an angle of 180 degrees. Thus, rotation of the side plate causes the inlets of the lubricating oil introduction passages and the outlets of the lubricating oil return passages to be corresponded to directions of rotation of the pump. Thus, it will be noted that the present invention permits rotation of the pump to be varied as desired without changing the structure of the pump.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein:

FIGS. 1 to 3 illustrate a conventional gear pump, wherein FIG. 1 is a sectional view taken along line I—I of FIG. 2, FIG. 2 is a sectional view taken along line II—II of FIG. 1 and FIG. 3 is an enlarged sectional view showing a portion indicated at reference character A in FIG. 1;

FIGS. 4 to 7 show an embodiment of a gear pump according to the present invention, wherein FIG. 4 is a vertical sectional view of the embodiment, FIG. 5 is a sectional view taken along line V—V of FIG. 4, FIG. 6 is a front elevation view showing a side plate incorporated in the embodiment and FIG. 7 is a schematic view showing the distribution of oil film pressure; and FIGS. 8 to 10 show another embodiment of a gear pump according to the present invention, wherein FIG. 8 is a vertical sectional view of the embodiment, FIG. 9 is a sectional view taken along line IX—IX of FIG. 8 and FIG. 10 is a schematic view showing the distribution oil film pressure.

DETAILED DESCRIPTION OF THE PREFERRED EMBODIMENT

Figure 1:
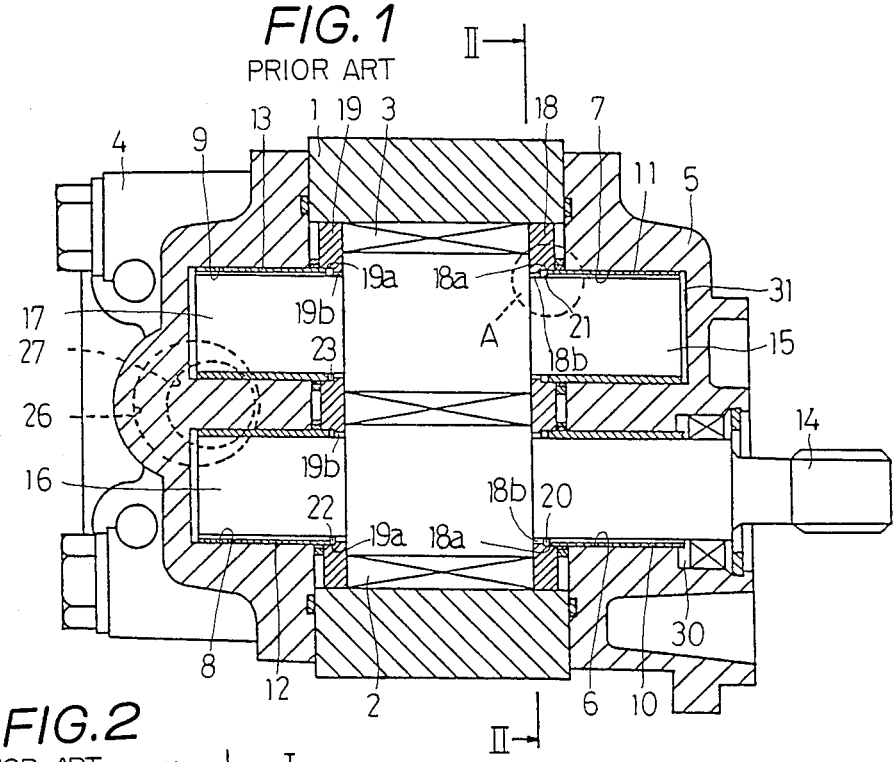
FIG. 1 PRIOR ART
Figure 2:
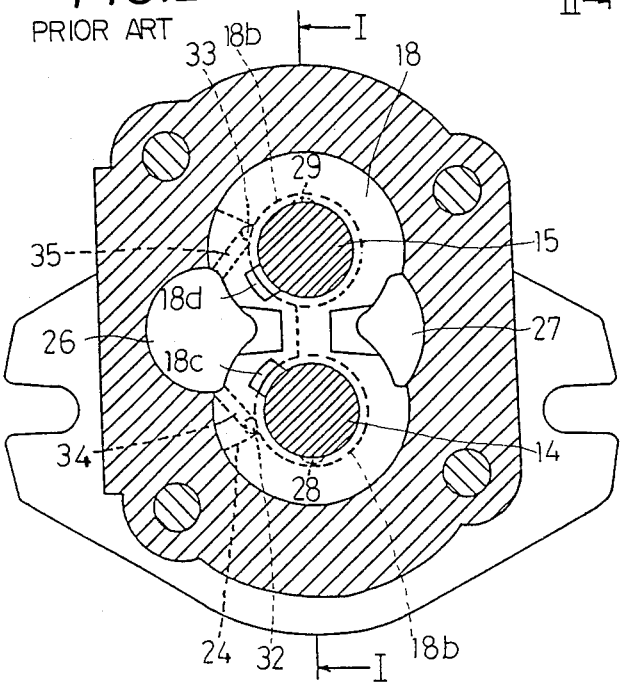
FIG. 2 PRIOR ART
Figure 3:
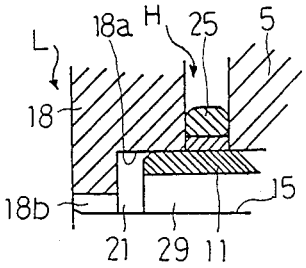
FIG. 3 PRIOR ART
Figure 4:
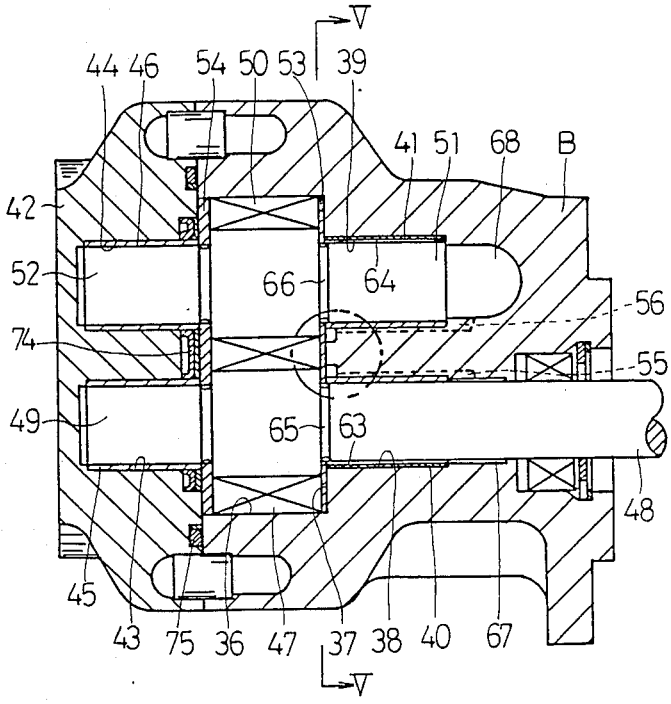

A gear pump according to the present invention will be described hereinafter with reference to FIGS. 4 to 10, wherein like reference numerals designate like or corresponding parts throughout.

FIGS. 4 to 7 show a first embodiment of a gear pump according to the present invention.

A gear pump shown in FIGS. 4 to 7 includes a pump body comprising a body section and a mounting flange like the body section 1 and mounting flange 5 in the conventional gear pump described above. However, the body section and mounting flange are integrally formed together. More particularly, the gear pump of the illustrated embodiment includes a body section B formed with a gear hole 36. The gear hole 36 is formed at a bottom 37 thereof with a pair of bushing insertion holes 38 and 39, in which bearing bushings 40 and 41 are pressedly inserted.

The gear pump of the illustrated embodiment also includes a cover 42 connected to one side of the body section B. In the illustrated embodiment, the pump body comprises the body section B formed integral with the mounting flange. However, in the present invention, the pump body may be understood to further include the cover. The cover 42 is formed with a pair of bushing insertion holes 43 and 44, in which bearing bushings 45 and 46 are pressedly inserted as in the body section B. The bearing bushings 40 and 45 are arranged so as to rotatably support therein gear shafts 48 and 49 of a driving gear 47 received in the gear hole 36, whereas the bearing bushings 41 and 46 are arranged so as to rotatably support therein gear shafts 51 and 52 of a driven gear 50 received in the gear hole 36.

Between both gears 47, 50 inserted in the gear hole 36 and the bottom 37 of the gear hole 36 is interposedly arranged a side plate 53. Also, a side plate 54 is interposedly arranged between both gears 47, 50 and the cover 42.

The bushing insertion holes 38 and 39 are formed on inner surfaces thereof with lubricating oil return passages 55, 57 and 56, 58 extending in axial directions thereof, respectively. The return passages 55 to 58 each are formed at one end thereof with an opening communicated to the bottom 37 of the gear hole 36. The openings of the return passages 55 and 57 are laterally symmetrically arranged on the basis of a vertical line defined by connecting centers of the gear shafts 48 and 51 together. Likewise, the openings of the return passages 56 and 58 are laterally symmetrically formed on the basis of the vertical line. Further, the openings of the return passages 55 and 56 are vertically symmetrically arranged on the basis of a horizontal line extending through a center of the vertical line and perpendicular to the vertical line. Likewise, the opening of the return passages 57 and 58 are vertically symmetrically arranged on the basis of the horizontal line.

Figure 5:
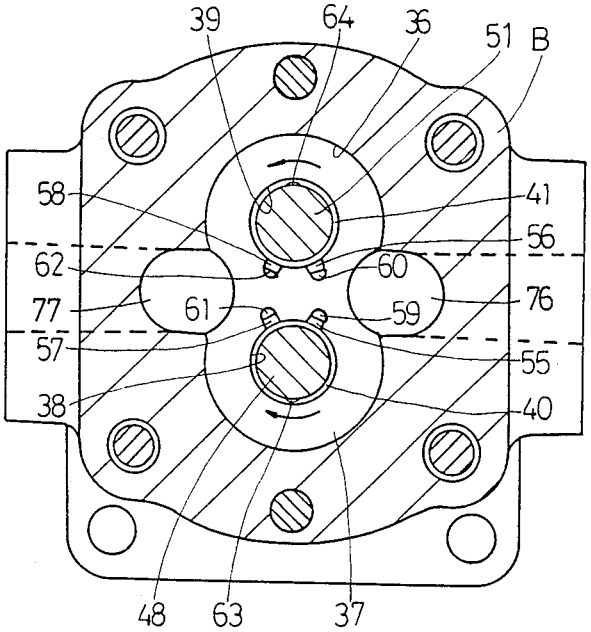

The bottom 37 of the gear hole 36, as shown in FIG. 5, is formed with recesses 59, 60, 61 and 62, which constitute outlets of the return passages 55, 56, 57 and 58, respectively. The outlets 59 to 62 likewise are formed vertically and horizontally symmetrically arranged in substantially the same manner as the openings of the return passages 55 to 58.

The bearing bushings 40 and 41 pressedly fitted in the bushing insertion holes 38 and 39 are formed on inner surfaces thereof with grooves each extending in an axial direction thereof. The gear shafts 48 and 51 are inserted in the bearing bushings 40 and 41, resulting in the so formed grooves of the bushings 40 and 41 constituting lubricating oil introduction passages 63 and 64. The so formed lubricating oil introduction passages 63 and 64 are communicated at one end thereof to annular grooves 65 and 66 formed at boundaries between the gears 47, 50 and one ends of the gear shafts 48, 51, respectively and at the other ends thereof to end chambers 67 and 68 formed in the body section B in a manner to be communicated to the bushing insertion holes 38 and 39. In the illustrated embodiment, the gear shaft 51 is arranged in the body section B so that the other end thereof terminates substantially at a boundary between the bushing insertion hole 39 and the end chamber 68, whereas the gear shaft 48 extends at the other end thereof through the bushing insertion hole 38 and end chamber 67.

Figure 6:
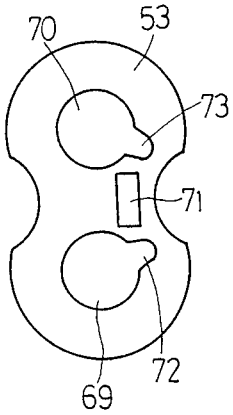

The side plate 53, as shown in FIG. 6, is formed into a substantially gourd-like shape corresponding to that of the gear hole 36 so that it may be fittedly mounted in the gear hole 36. The side plate 53 is formed with throughholes 69 and 70 for inserting the gear shafts 48 and 51 therethrough, respectively. Further, the side plate 53 is formed with a through-hole 71 concurrently communicated to the two outlets 59, 60 or 61, 62 and also formed with cutouts 72 and 73 which are communicated to the throughholes 69 and 70 on a side of the through-hole 71. In the embodiment, the through-holes 69 and 70 each are formed into a circular shape and the through-hole 71 is formed into a rectangular shape.

The side plate 54 arranged on a side of the cover 42 is provided on a rear or outer surface thereof with sealing members 74 and 75 to define a loading area on the outer surface of the side plate 54.

Reference numerals 76 and 77 designates chambers defined on both sides of the gear hole 36 as in the conventional gear pump described above. The chambers 76 and 77 are adapted to alternately serve as a suction chamber and a discharge chamber.

The remainder of the gear pump of the illustrated embodiment may be constructed in a manner similar to the conventional gear pump described above.

The manner of operation of the gear pump of the illustrated embodiment constructed as described above will be described hereinafter.

When the driving gear 47 and driven gear 50 are rotated in directions indicated by arrows in FIG. 5, the chamber 76 serves as a suction chamber and the chamber 77 serves as a discharge chamber. For such rotation of both gears 47 and 50, the rectangular through-hole 71 of the side plate 53 is positioned on a side of the suction chamber 76.

Positioning of the through-hole 71 on the side of the suction chamber 76 causes the outlets 59 and 60 of the return passages 55 and 57 to be communicated to the suction chamber 76 through the through-hole 71, whereas the outlets 61 and 62 of the return passages 57 and 58 communicated thereto are metal-sealed by the side plate 53. This causes low pressure oil sucked in the suction chamber 76 to be discharged through tooth spaces of both gears 47 and 48 toward the discharge chamber 77, during which a part of the low pressure oil included in the tooth spaces is circulated through the cutouts 72 and 73, annular grooves 65 and 66, lubricating oil introduction passages 63 and 64, end chambers 67 and 68, lubricating oil return passages 55 and 56, outlets 59 and 60 and through-hole 71 and returned to the suction chamber 76.

When the gears 47 and 50 of the pump are rotated in directions opposite to those indicated by the arrows in FIG. 5, the chamber 77 and 76 are varied to serve as a suction chamber and a discharge chamber, respectively which results in, the side plate 53 being rotated by an angle of 180 degrees to position the through-hole 71 on a side of the chamber 77 serving as the suction chamber.

This causes the lubricating oil return passages 55 and 56 and the outlets 59 and 60 communicated thereto to be metal-sealed by the side plate 53, resulting in low pressure oil for lubrication being circulated through the return passages 57 and 58, outlets 61 and 62 and throughhole 71 and returned to the suction chamber 77.

Figure 7:
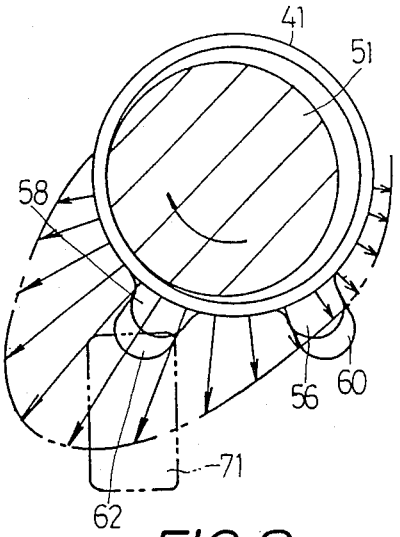

In the illustrated embodiment, the lubricating oil return passages 55 to 58, as shown in FIG. 7, are formed at positions which cause oil film pressure in each of the bearing bushings 40 and 41 to be maximized. Accordingly, operation of the gear pump may causes the oil film pressure to deform the lubricating oil return passages 55 to 58. Thus, it will be noted that the gear pump of the illustrated embodiment is suitable for operation under low discharge pressure.

Figure 9:
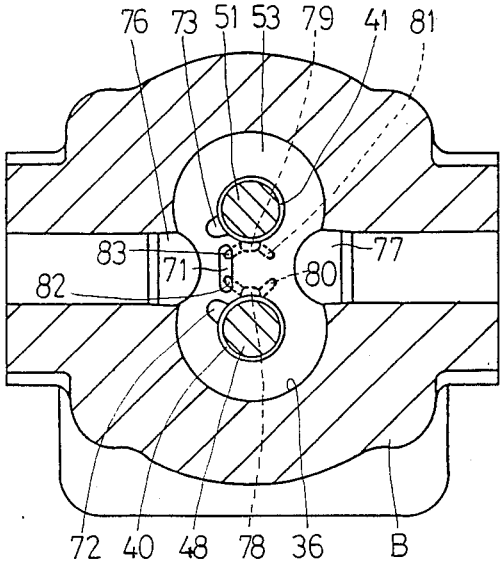
Figure 8:
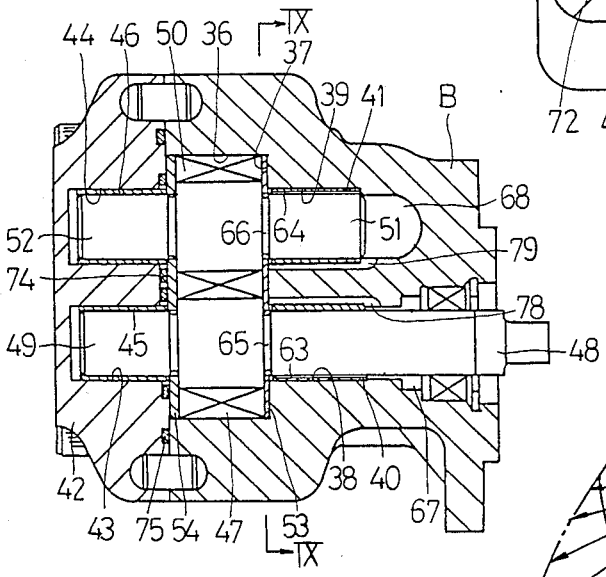
Figure 10:
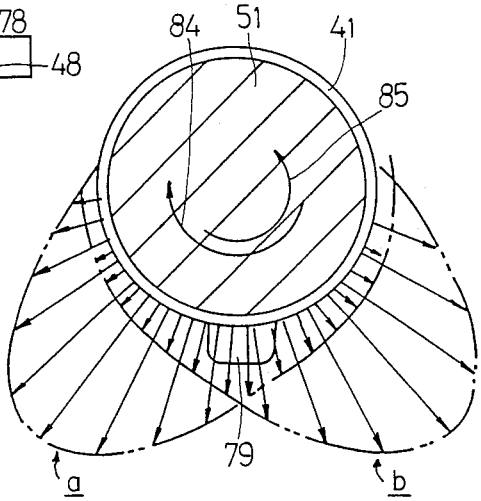

FIGS. 8 to 10 show a second embodiment of a gear pump according to the present invention which is suitable for operation under high discharge pressure.

In a gear pump of the second embodiment, lubricating oil return passages 78 and 79 are formed in bushing insertion holes 38 and 39, respectively; however, the return passages 78 and 79 are positioned in a manner different from in the first embodiment described above.

More particularly, the lubricating oil return passages 78 and 79, as shown in FIG. 9, are formed at portions of gear shafts 48 and 49 opposite to each other and so as to be positioned on a vertical line defined by connecting centers of the gear shafts 48 and 49 together.

The return passage 78 is formed with a pair of outlets 80 and 82 which are arranged in a manner to obliquely upwardly extend in directions apart from each other from the return passage 78 and be laterally symmetric on the basis of the vertical line. Likewise, the return passage 79 is formed with a pair of outlets 81 and 83 which are arranged in a manner to obliquely downwardly extend in directions apart from each other from the return passage 79 and be laterally symmetric on the basis of the vertical line. Also, the outlets 80 and 82 and the outlets 81 and 83 are arranged in a manner to be symmetric to each other on the basis of a horizontal line passing through a center of the vertical line and perpendicular thereto.

As shown in FIG. 9, the outlet 82 communicated to one lubricating oil return passage 78 and the outlet 83 communicated to the other lubricating oil return passage 79 are communicated to each other through a through-hole 71 of a side plate 53. Rotation of the side plate 53 by an angle of 180 degrees causes the outlet 80 communicated to the lubricating oil return passage 79 and the outlet 81 communicated to the lubricating oil return passage 79 to be communicated to each other through the through-hole 71 of the side plate 53.

FIG. 10 shows the distribution of oil film pressure obtained by rotating a gear in directions indicated by arrows 84 or 85, wherein reference characters a and b indicate the distributions obtained by rotating the gear in the directions 84 and 85, respectively.

As is noted from FIG. 10, rotation of the gear 47 or 50 in either direction at an area at which the lubricating oil return passages 78 and 79 are formed or on a line defined by connecting centers of the gear shafts 48 and 49 does not cause a significant increase in oil film pressure in each of bearing bushings 40 and 41.

Thus, the second embodiment restrains a substantial increase in oil film pressure at the position at which the lubricating oil return passages 78 and 79 are provided irrespective of the direction of rotation of each gear, so that a portion of each of the bearing bushings corresponding to the passages 78 and 79 may be effectively prevented from being deformed or damaged. Accordingly, it will be noted that the gear pump of the second embodiment bears high pressure as compared to the first embodiment described above.

In each of the embodiments described above, annular grooves 65 and 66 are defined between the gears 47 and 50 and the gear shafts 48 and 51, respectively. However, in the present invention, gaps like the gaps 20 and 21 in the conventional gear pump described above may be defined in the side plate.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed is:

1. A gear pump comprising:

a pump body formed with a gear hole and bushing insertion holes;

gears arranged in said gear hole;

bearing bushings pressedly inserted in said bushing insertion holes, said bearing bushings each being formed on an inside thereof with a lubricating oil introduction passage and on an outside thereof with a lubricating oil return passage;

gear shafts rotatably supported in said bearing bushings;

at least one side plate arranged on at least one side of said gears; and a suction chamber defined in said pump body so as to circulate a part of hydraulic fluid in said suction chamber through said lubricating oil introduction passages and said lubricating oil return passages;

said lubricating oil return passages having outlets positioned in a manner to be laterally symmetric on the basis of a vertical line defined by connecting centers of said gear shafts together and vertically symmetric on the basis of a horizontal line extending through a center of said vertical line and perpendicular to said vertical line and inlets;

said at least one side plate being formed with a through-hole which is positioned on one side of said vertical line so as to be communicated to said outlets of said lubricating return passage vertically symmetric on the basis of said horizontal line and a cutout for communicating said inlet of said lubricating oil introduction passage to said suction chamber.

2. A gear pump as defined in claim 1, wherein said bushing insertion holes each are formed with a pair of said lubricating oil return passages and each of said lubricating oil return passages is provided with said outlet.

3. A gear pump as defined in claim 1, wherein said bushing insertion holes each are formed with one said lubricating oil return passage;

said lubricating oil return passages being so arranged that one end thereof is positioned opposite to each other on a line defined by connecting centers of said bushing insertion holes together;

each of said one end of said lubricating oil return passages being formed with a pair of outlets obliquely extending in directions apart from each other.

* * * * *